US007006044B2

(12) United States Patent
Choi et al.

(10) Patent No.: US 7,006,044 B2
(45) Date of Patent: Feb. 28, 2006

(54) MICROSTRIP PATCH ANTENNA USING MEMS TECHNOLOGY

(75) Inventors: Won-Kyu Choi, Gyeonggi-Do (KR); Yong-Heui Cho, Daejon (KR); Cheol-Sig Pyo, Daejon (KR); Soon-Ik Jeon, Daejon (KR); Chang-Joo Kim, Daejon (KR)

(73) Assignee: Electronics and Telecommunications Research Institute, (KR)

( * ) Notice: Subject to any disclaimer, the term of this patent is extended or adjusted under 35 U.S.C. 154(b) by 0 days.

(21) Appl. No.: 10/865,382

(22) Filed: Jun. 9, 2004

(65) Prior Publication Data

US 2005/0104778 A1 May 19, 2005

(30) Foreign Application Priority Data

Nov. 17, 2003 (KR) ..... 10-2003-0081168

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 5,061,939 A * 10/1991 Nakase ..... 343/700 MS
6,069,587 A 5/2000 Lynch et al.
6,255,994 B1 * 7/2001 Saito ..... 343/700 MS
6,384,797 B1 5/2002 Schaffner et al.
6,501,427 B1 12/2002 Lilly et al.
6,567,047 B1 * 5/2003 Kuck ..... 343/700 MS
6,831,608 B1 * 12/2004 Arvidsson ..... 343/700 MS
6,882,318 B1 * 4/2005 Nevermann ..... 343/702

FOREIGN PATENT DOCUMENTS

JP 2002-261533 9/2002
KR 1020030013739 2/2003

OTHER PUBLICATIONS

B.A. Cetiner et al., "Monolithic Integration of RF MEMS Switches With a Diversity Antenna on PCB Substrate", IEEE Transactions on Microwave Theory and Techniques, vol. 51, No. 1, Jan. 2003, (pp. 332-335).

M. Abdel-Aziz et al., "Design, Implementaion and Measurement of 26.6 GHz Patch Antenna using MEMS Technology", 0-7803-7846-6/03/ IEEE (pp. 399-402).

* cited by examiner

*Primary Examiner*—Tan Ho
(74) *Attorney, Agent, or Firm*—Blakely Sokoloff Taylor & Zafman

(57) ABSTRACT

A microstrip patch antenna formed by using a microelectromechanical system technology is included. The microstrip patch antenna includes: a substrate provided with a ground formed on a bottom surface of the substrate; a feeding line formed on a top surface of the substrate for feeding an electric power; a coupling stub formed on the top surface of the substrate and electrically connected to the feeding line; a plurality of supporting posts erected on the top surface of the substrate; and a radiating patch formed on the supporting posts, thereby forming an area of air between the radiating patch and the top surface of the substrate.

12 Claims, 4 Drawing Sheets

MICROSTRIP PATCH ANTENNA USING MEMS TECHNOLOGY

FIELD OF THE INVENTION

The present invention relates to a microstrip patch antenna; and, more particularly, to a microstrip patch antenna formed by using a microelectro-mechanical system technology.

DESCRIPTION OF RELATED ARTS

Recently, a technology of microelectro-mechanical system (MEMS) has been widely applied to various fields such as an optical science, a sensor, a motor, a somatology and a radio frequency (RF) field. Specially, in the RF field, the technology of MEMS has been studied for developing low noise equipments, filters, inductors, switches and antennas.

There are various schemes for MEMS technology, such as a bulk micromachining, a surface micromachining, a fusion bonding and a lithographie galvanoforming abformung (LIGA). For the antenna field, a radiating patch is printed on a thin film. And, the radiation efficiency of the radiating patch is improved by adjusting the dielectric constant under the radiating patch so as to match with that of an air by using the bulk micromachining technology.

A high efficient broadband MEMS antenna is introduced in an article by M. Abdel-Aziz, H. Ghali, H Ragaie, H. Haddara, E. Larigue, B. Guilon and P. Pons, entitled "Design, Implementation and Measurement of 26.6 GHz Patch Antenna using MEMS Technology", *IEEE AP-s Vol.* 1, pp. 399–402, Jun. 2003.

In the article, a structure of antenna is introduced for overcoming the problem of antenna characteristics deteriorated when a device including antennas is integrated on a silicon substrate with a high dielectric constant.

That is, when the antenna is implemented on the silicon substrate, a surface wave is increased and a bandwidth becomes narrow. Therefore, the efficiency of radiation can be reduced and an amount of loss can be increased by the dielectric constant of the silicon substrate. These problems can be overcome by removing the silicon substrate under the radiating patch using the bulk micromachining after printing the radiating patch on the membrane film formed on the silicon substrate.

FIG. 1 is a perspective view illustrating a conventional microstrip patch antenna by using a microelectro-mechanical system (MEMS) technology.

As shown, the microstrip patch antenna 100 includes a high resistivity silicon (HRS) substrate 140, a thin dielectric membrane 110, a metal microstrip patch 120 and a feeding line 130 formed on the thin dielectric membrane 110.

The used MEMS technology is based on a stress compensated thin dielectric membrane 110 consisting of SiO2/Si3N4 deposited on the HRS substrate 140. After the thin dielectric membrane 110 is deposited, the metal microstrip patch 120 and the feeding line 130 are patterned on the topside of the thin dielectric membrane 110 using a gold electroplating technique. The HRS substrate 140 is then completely etched underneath the metal microstrip patch 120 until it is left suspended on the thin dielectric membrane 110. This configuration provides a localized low dielectric constant region just around and below the metal microstrip patch 120.

However, it is difficult to maintain evenness of the thin dielectric membrane 110 when the portion of the HRS substrate 140 underneath the metal microstrip patch 120 is etched.

Furthermore, it is difficult to form a switch on the thin dielectric membrane 110 to provide multi-band characteristics to the conventional microstrip patch antenna.

SUMMARY OF THE INVENTION

It is, therefore, an object of the present invention to provide a microstrip patch antenna of improved radiation efficiency and broadband characteristic by using a plurality of supporting posts to support a radiating patch for forming an air under the radiating patch.

It is another object of the present invention to provide a microstrip patch antenna of multi-band characteristics by additionally using a plurality of switches to change a resonance length of the radiating patch.

In accordance with an aspect of the present invention, there is provided a microstrip patch antenna includes: a substrate provided with a ground formed on a bottom surface of the substrate; a feeding line formed on a top surface of the substrate for feeding an electric power; a coupling stub formed on the top surface of the substrate and electrically connected to the feeding line; a plurality of supporting posts erected on the top surface of the substrate; and a radiating patch formed on the supporting posts, thereby forming an area of air between the radiating patch and the top surface of the substrate.

In accordance with another aspect of the present invention, there is provided a microstrip patch antenna includes: a substrate provided with a ground; a first metal pattern formed on a first portion of the substrate; a radiating unit for radiating a radio frequency signal; a supporting unit for supporting the radiating unit; and a second metal pattern formed on a second portion of the substrate wherein the resonance length is controlled by electrically switching the second metal pattern.

BRIEF DESCRIPTION OF THE DRAWINGS

The above and other objects and features of the present invention will be better understood with regard to the following description of the preferred embodiments given in conjunction with the accompanying drawings, in which.

DETAILED DESCRIPTION OF THE INVENTION

Hereinafter, a microstrip patch antenna in accordance with preferred embodiments of the present invention will be described in more detail with reference to the accompanying drawings.

Figure 1:
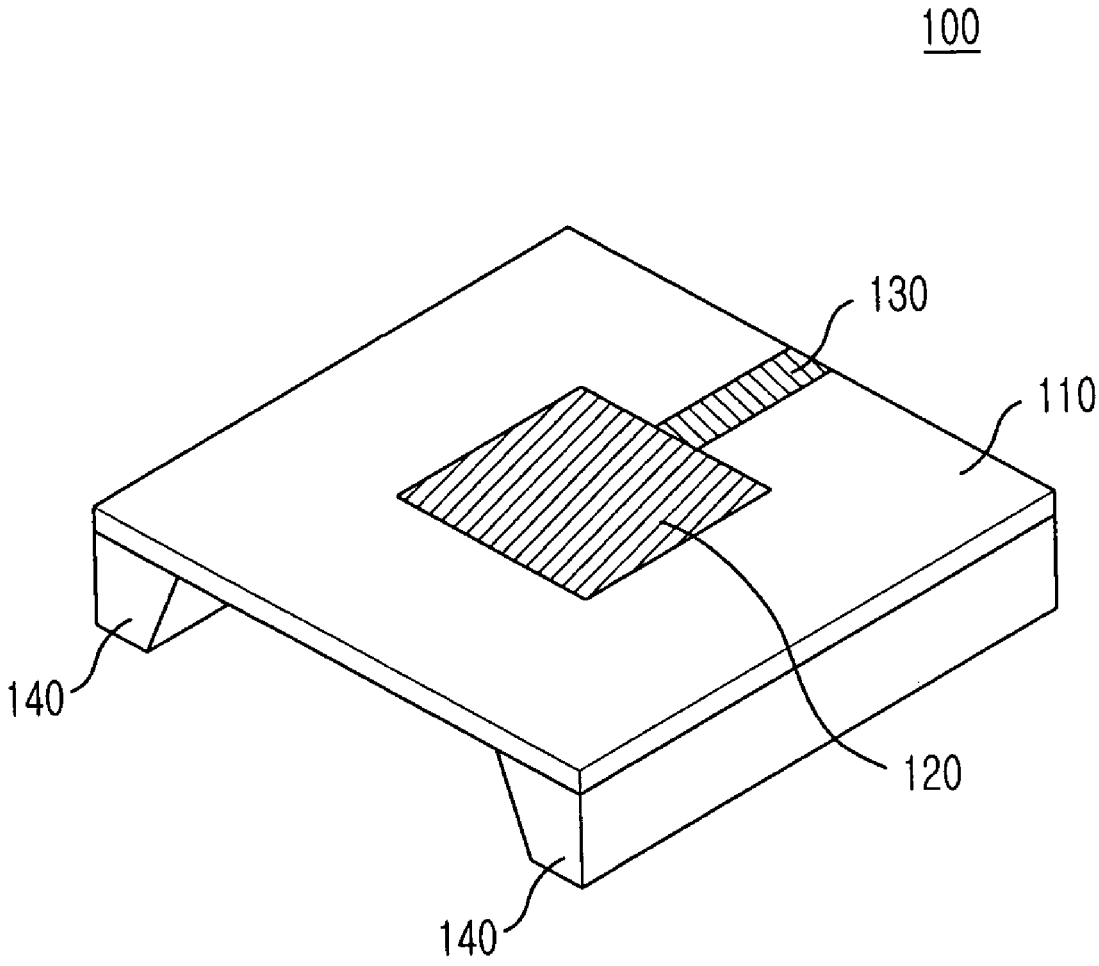
FIG. 1 is a perspective view illustrating a conventional microstrip patch antenna using a microelectro-mechanical system.
Figure 2A:
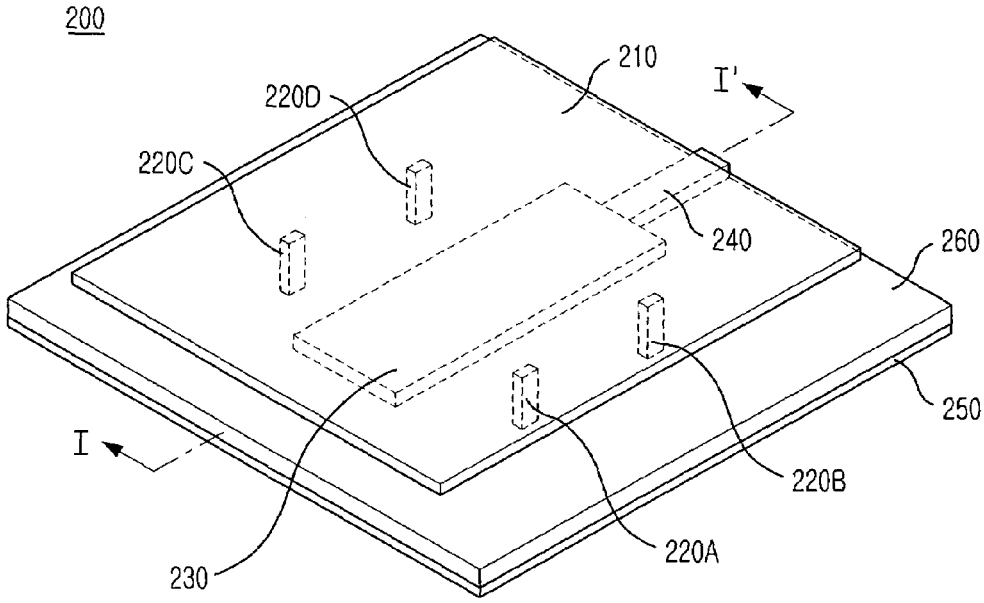
FIG. 2A is a perspective view illustrating a microstrip patch antenna in accordance with a preferred embodiment of the present invention.

FIG. 2A is a view illustrating a microstrip patch antenna in accordance with a preferred embodiment of the present invention.

As shown, the microstrip patch antenna 200 includes a substrate 260 provided with a ground 250 formed on a bottom surface of the substrate 260, a feeding line 240 and a coupling stub 230 formed on a top surface of the substrate 260, four supporting posts 220A, 220B, 220C, 220D erected on the substrate 260 and a radiating patch 210 is put on the four supporting posts 220A, 220B, 220C, 220D.

In accordance with the preferred embodiment of the present inventions, the substrate 260 is made of a silicon wafer having a high dielectric constant. The supporting posts 220A, 220B, 220C, 220D are made of conductive material such as a metal and a silver. Although the preferred embodiment of the present invention describes that the radiating patch 210 is floated in the air by the four rectangular supporting posts 220A, 220B, 220C, 220D, a shape, size and number of the supporting post can be changed in case when they achieve the object of the present invention.

The feeding line 240 is electrically connected to the coupling stub 230 and feeds an electric power transmitted from a power supply (not shown) to the coupling stub 230, thereby electromagnetically coupling to the radiating patch 210. The four supporting posts 220A, 220B, 220C, 220D are appropriately erected on the substrate 260 to support the radiating patch 210. Therefore, an area of air is formed between the radiating patch 210 and the substrate 260.

The four supporting posts 220A, 220B, 220C, 220D are erected to support the radiating patch 210 in such a way that they minimize the disturbance of a dominant mode of an electric field excited in the radiating patch 210. The electric power is fed to the coupling stub 230 through the feeding line 240 in response to a signal transmitted from outside and electromagnetically coupled to the radiating patch 210 by the coupling stub 230. Therefore, the radiating patch 210 is capable of radiating a radio frequency (RF) signal in response to the signal, vice versa, the radiating patch 210 is capable of receiving an RF signal for converting into an electric signal.

In accordance with the preferred embodiment of the present invention, a dielectric constant under the radiating patch 210 can be varied by adjusting the area of air between the radiating patch 210 and the substrate 260.

In accordance with the preferred embodiment of the present invention, as described above the four supporting posts 220A, 220B, 220C, 220D are made of a conductive material and the four supporting posts 220A, 220B, 220C, 220D are erected on the substrate 260 to support the radiating patch 210. Preferably, each supporting post 220 is connected to the radiating patch 210 in such a way that they minimize the disturbance of a dominant mode of the electric field excited to the radiating patch 210.

Although the radiating patch 210 of the preferred embodiment of the present invention is designed in a form of rectangular, but a shape of the radiating patch 210 can be modified to other shape.

Figure 2B:
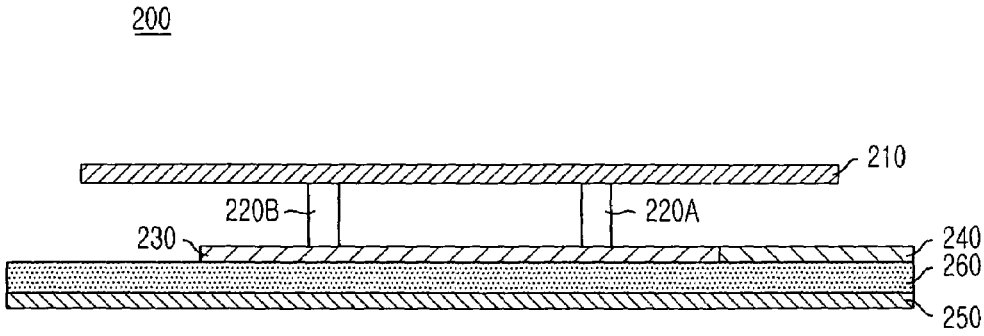
FIG. 2B is a cross-sectional view of the microstrip patch antenna taken along a line I–I' shown in FIG. 2A.

FIG. 2B is a cross-sectional view of the microstrip patch antenna taken along a line I–I' shown in FIG. 2A.

FIG. 2B shows that the coupling stub 230 is formed under of the radiating patch 210 and the radiating patch 210 is put on the supporting posts 220A, 220B, 220C, 220D for forming the air under the radiating patch 210.

Figure 3A:
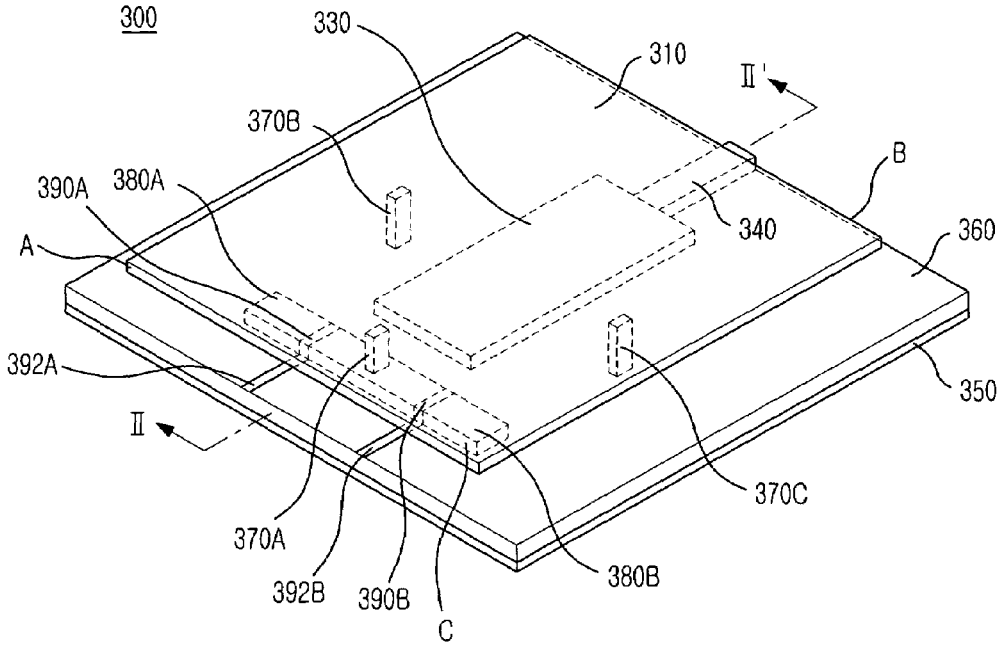
FIG. 3A is a view of a microstrip patch antenna in accordance with another preferred embodiment of the present invention.

FIG. 3A is a view of a microstrip patch antenna in accordance with another preferred embodiment of the present invention.

As shown, the microstrip patch antenna 300 includes a substrate 360 provided with a ground 350 formed on a bottom surface of the substrate 360, a feeding line 340 and a coupling stub 330 formed on the a top surface of the substrate 360, a plurality of supporting posts 370A, 370B, 370C erected on the substrate 360 and a radiating patch 310 put on the supporting posts 370A, 370B, 370C. The microstrip patch antenna 300 further includes a plurality of metal strips 380A, 380B formed on the substrate 360 and electrically coupled to one 370A of the supporting posts 370A, 370B, 370C, a first and a second switches 390A, 390B formed on the metal strips 380 and a plurality of electric lines 392A, 392B electrically connected to the first and the second switches 390A and 390B, respectively.

Figure 3B:
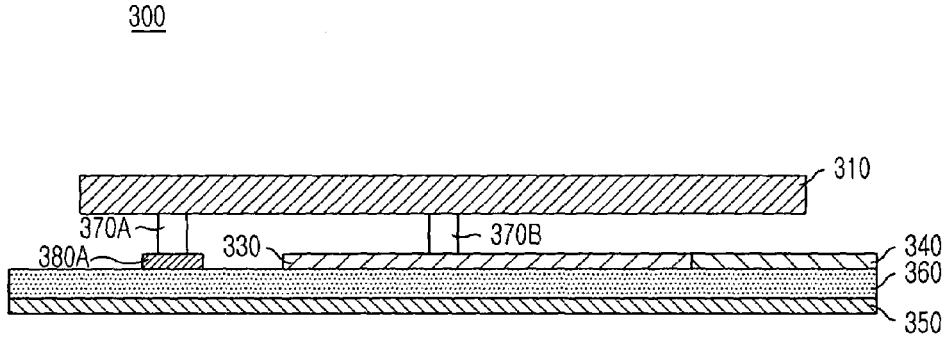
FIG. 3B is a cross-sectional view of the microstrip patch antenna taken along a line II–II' FIG. 3A.

FIG. 3B is a cross-sectional view of the microstrip patch antenna 300 taken along a line II–II' of FIG. 3A.

As shown, the supporting post 370A coupled to the metal strips 380A, 380B is erected on the substrate 360 to support an area of a radiating edge A of the radiating patch 310 where the electric field is most strongly radiated. The supporting post 370A coupled to the metal strips 380A, 380B is made of metal for electrically connecting to the metal strips 380A, 380B for controlling a resonance length of the microstrip patch antenna 300. The first and the second switches 390A, 390B are formed on the metal strips 380A, 380B and turned ON or OFF in response to a DC bias signal through the electric lines 392A and 392B.

If the first and the second switches 390A and 390B are turned off, the resonant frequency of the microstrip patch antenna is dominantly decided by the length of the radiating patch. In the other hand, if the switches 390A and 390B are turn on, the resonant frequency of the microstrip patch antenna is dominantly decided by the lengths of the radiating patch and the metal strips 380A and 380B. That is, the resonance length of the microstrip patch antenna 300 is controlled by ON-OFF state of the first and the second switches 390A and 390B. In off-state, the microstrip patch antenna is resonant in high frequency band and in on-state, the microstrip patch antenna is resonant in low frequency band. Therefore, the microstrip patch antenna 300 can have a multi-band characteristic by changing the resonance length according to the ON-OFF state of the first and the second switches 390A and 390B.

Figure 4:
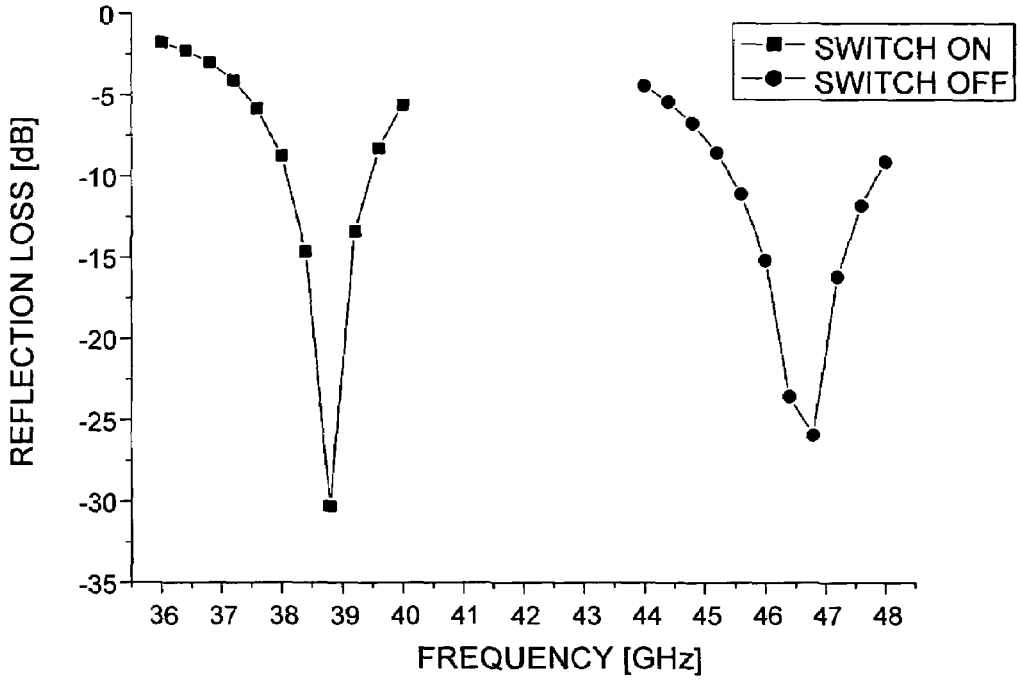
FIG. 4 is a graph showing a multi-band characteristic of the microstrip patch antenna of FIGS. 3A and 3B.

FIG. 4 is a graph showing a multi-band characteristic of the microstrip patch antenna of FIGS. 3A and 3B.

As shown, a curve with solid rectangular shape of dots in a left side of the graph shows that the microstrip patch antenna 300 is resonant at a frequency range from approximately 38.5 GHz to approximately 39 GHz when the first and the second switches 390A and 390B are turned on. A curve with hatched dots in a right side of the graph shows that the microstrip patch antenna 300 is resonant at a frequency range from approximately 46.5 GHz to 47 GHz when the first and the second switches 390A and 390B are turned off.

In accordance with the preferred embodiments of the present invention, the microstrip patch antenna 300 can improve the radiation efficiency and bandwidth characteristic by using a plurality of supporting posts to support a radiating patch for forming an air under the radiating patch.

Furthermore, the microstrip patch antenna 300 can have multi-band characteristics by additionally using a plurality of switches to change a resonance length of the radiating patch.

The present application contains subject matter related to Korean patent application No. KR 2003-0081168, filed in the Korean patent office on Nov. 17, 2003, the entire contents of which being incorporated herein by reference.

While the present invention has been described with respect to certain preferred embodiments, it will be apparent to those skilled in the art that various changes and modifications may be made without departing from the spirit and scope of the invention as defined in the following claims.

What is claimed is:

1. A microstrip patch antenna comprising:

a substrate provided with a ground formed on a bottom surface of the substrate;

a feeding line formed on a top surface of the substrate for feeding an electric power;

a coupling stub formed on the top surface of the substrate and electrically connected to the feeding line;

a plurality of supporting posts erected on the top surface of the substrate; and a radiating patch formed on the supporting posts, thereby forming an area of air between the radiating patch and the top surface of the substrate.

2. The microstrip patch antenna of claim 1, wherein the plurality of supporting posts is arranged in such a way that they do not disturb a dominant mode of a radio frequency emitted from the radiating patch.

3. The microstrip patch antenna of claim 2, wherein the plurality of supporting posts are made of metal.

4. The microstrip patch antenna of claim 1, wherein the radiating patch is rectangular.

5. The microstrip patch antenna of claim 1, wherein the plurality of supporting posts is placed within the distance from a radiating edge of the radiating patch.

6. The microstrip patch antenna of claim 1, further comprising:

a metal strip formed on the top surface of the substrate electrically connected to one of the supporting posts;

at least one switch formed on the metal strip; and at least one electric line connected to the switch.

7. The microstrip patch antenna of claim 6, wherein the one connected supporting post is connected to a radiating edge of the radiating patch.

8. The microstrip patch antenna of claim 6, wherein the at least one switch is formed by using a microelectro-mechanical system (MEMS).

9. The microstrip patch antenna of claim 6, wherein a resonance length of the antenna is controlled by turning on and off at least one of the at least one switches.

10. The microstrip patch antenna of claim 1, wherein substrate is made of a silicon wafer having a high dielectric constant.

11. A microstrip patch antenna for controlling a resonance length thereof, comprising:

a substrate provided with a ground;

a first metal pattern formed on a first portion of the substrate;

means for radiating a radio frequency signal;

means for supporting the radiating means; and a second metal pattern formed on a second portion of the substrate wherein the resonance length is controlled by electrically switching the second metal pattern.

12. The microstrip patch antenna of claim 11, further comprising a switch formed on the second metal pattern.

* * * * *